United States Patent [19]

Boyce et al.

[11] Patent Number: 4,941,495

[45] Date of Patent: Jul. 17, 1990

[54] CONVALESCENT AID

[76] Inventors: Marion E. Boyce; Henrietta E. Boyce, both of Timbercreek Apt. 310, 415 Augusta Blvd., Naples, Fla. 33962

[21] Appl. No.: 427,973

[22] Filed: Oct. 26, 1989

Related U.S. Application Data

[63] Continuation of Ser. No. 241,088, Sep. 6, 1988, abandoned.

[51] Int. Cl.[5] ..... A61H 3/00

[52] U.S. Cl. ..... 135/65; 135/67; 135/72; 135/75

[58] Field of Search ..... 135/65, 69, 72, 67, 135/DIG. 9, 75

[56] References Cited

U.S. PATENT DOCUMENTS

| | | | |
|---|---|---|---|
| D. 179,394 | 12/1956 | Mills . | |
| D. 199,957 | 1/1965 | Bertoldo . | |
| D. 208,607 | 9/1967 | Williams | 135/67 |
| 2,522,394 | 9/1950 | Myers . | |
| 2,565,257 | 8/1951 | Nichol . | |
| 2,734,554 | 2/1956 | Ries . | |
| 2,757,388 | 8/1956 | Chisholm | 135/65 |
| 2,817,347 | 12/1957 | Hilt Sr. | 135/65 |
| 3,272,530 | 9/1966 | Klassen . | |
| 3,286,283 | 11/1966 | Bertoldo . | |
| 3,387,617 | 6/1968 | Reiber | 135/67 |
| 3,739,793 | 6/1973 | Wilson . | |
| 3,914,806 | 10/1974 | Pearce . | |
| 3,968,810 | 7/1976 | Thomas | 135/67 |
| 4,642,824 | 2/1987 | Hodges . | |

FOREIGN PATENT DOCUMENTS

| | | | |
|---|---|---|---|
| 602199 | 7/1960 | Canada | 135/67 |
| 2274274 | 1/1976 | France | 135/67 |

*Primary Examiner*—David A. Scherbel
*Assistant Examiner*—Caroline D. Dennison
*Attorney, Agent, or Firm*—Lockwood, Alex, FitzGibbon & Cummings

[57] ABSTRACT

A convalescent aid is disclosed for assisting partially incapacitated persons in sitting down or standing up from an elevated surface. The convalescent aid of the present invention includes a pair of parallel spaced-apart handle portions which may be grasped by a person to support his or her body weight while sitting down or standing up. In one embodiment, the aid can be positioned for use on top of the elevated surface such as a bed or sofa, for example. In an alternate embodiment, the aid may include extended front legs which extend down to the floor, thereby providing a more stable support for the person's weight.

24 Claims, 2 Drawing Sheets

CONVALESCENT AID

This application is a continuation of application Ser. No. 241,088, filed Sept. 6, 1988.

BACKGROUND AND SUMMARY OF THE INVENTION

This invention relates to a convalescent aid for assisting persons who are partially incapacitated but still have the use of their arms and hands. More specifically, the invention relates to a convalescent aid by which partially incapacitated individuals may obtain leverage with their arms to assist in sitting down or standing up.

A person who is convalescing or who has been partially incapacitated due to, for example, an injury, disease, or as a consequence of old age may require assistance in sitting down or standing up from an elevated surface, such as a bed or sofa. The present invention is intended to provide such assistance to those persons who, although partially incapacitated, still have use of their hands and arms and, with such assistance, are able to move between a standing position and a sitting position.

As described more fully to follow, a convalescent aid incorporating the principles of the invention is light in weight, compact and simple and inexpensive in construction and use. Such aid includes a pair of parallel spaced-apart handles or branch portions which may be grasped by the user to support his or her body weight while sitting down or standing up. In the preferred embodiment, a light-weight, portable, compact and adjustable tubular construction is provided. In one embodiment, an aid incorporating the principles of the present invention can be positioned for use on an elevated substantially flat surface such as on top of a bed, for example. In an alternate embodiment, the aid may be provided with extended front legs which extend down to the floor, thereby providing a more stable support for the user's weight. In both of the described embodiments, expansion means may be provided whereby the distance between the parallel handles may be adjusted to accommodate the individual requirements of the user. Similarly, the front legs of the aid may be provided with extension means to vary their respective lengths for the purpose of enhancing the overall utility of the aid and for the purpose of providing the user with an optimum degree of comfort, as more fully explained to follow.

These and other objects, features and advantages of the present invention will become more apparent upon consideration of the following detailed description of the preferred embodiments of the invention.

BRIEF DESCRIPTION OF THE DRAWINGS

In the course of the description of the preferred embodiment of the invention, reference will be made to the drawings in which.

DETAILED DESCRIPTION OF THE PREFERRED EMBODIMENTS

Figure 1:
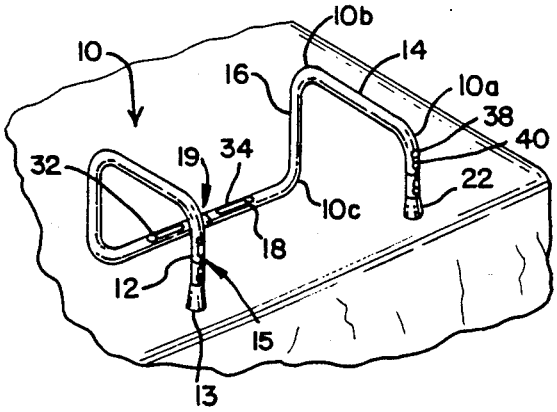
FIG 1 is a perspective view of one preferred embodiment of a convalescent aid incorporating the principles of the present invention.
Figure 2:
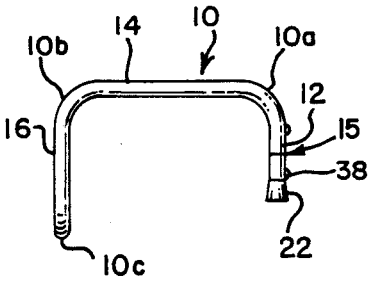
FIG 2 is a side elevational view of the convalescent aid substantially as shown in FIG. 1.
Figure 3:
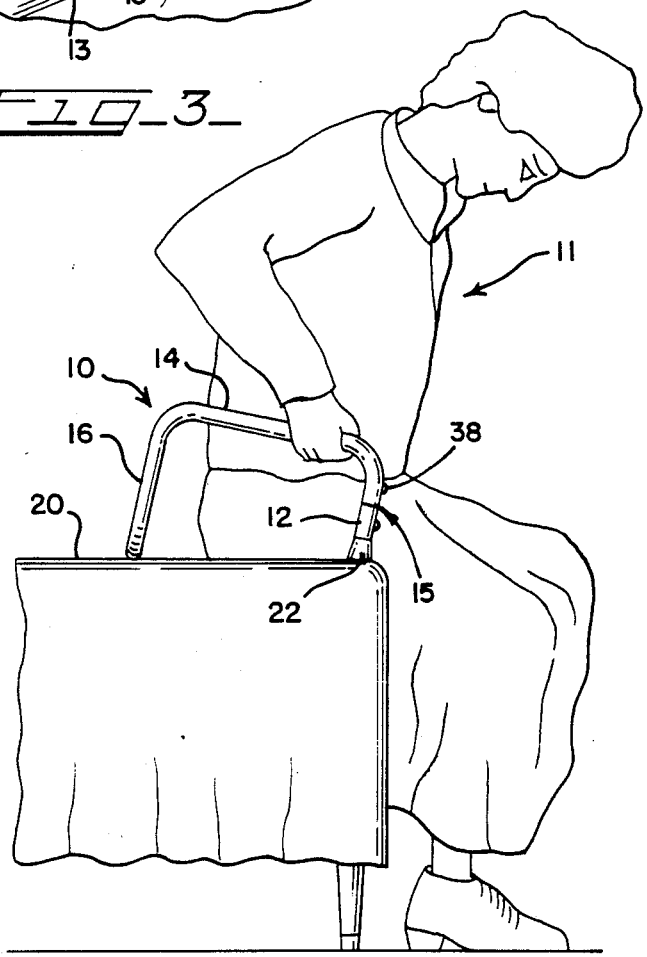
FIG 3 is a perspective view of the convalescent aid substantially as shown in FIG. 2, and further depicting the use thereof by a person.

Referring generally to FIGS. 1 through 3, a first embodiment is shown of a convalescent aid 10 incorporating the principles of the invention. This embodiment of convalescent aid 10 is intended principally for positioning entirely on top of a flat elevated surface such as, for example, on top of a bed 20. As generally depicted in FIG. 3, and further discussed below, the convalescent aid 10 allows a convalescent or disabled person to move more readily between a sitting position and a standing position from the surface 20 by allowing a better purchase with the hands and arms.

The aid 10 is preferably formed of a light-weight and metallic tubular construction. As shown, the aid 10 includes two spaced-apart handles 14. Each of the handles 14 defines a longitudinal axis which extends into and terminates at each of curved portions 10*a* and 10*b*. Front leg portions 12 extend substantially vertically downward from the curved portions 10*a* of the parallel-spaced handles 14. When the device 10 is used, the front leg portions 12 are generally positioned near the edge of the flat surface 20, as shown in FIG. 3.

Rear leg portions 16 also extend vertically downward from the curved portions 10*b* of the handles 14. Each of the front legs 12 and the rear legs 16 define vertically extending axes which are substantially perpendicular to the handles 14 from which they extend. Rear leg portions 16 extend into and terminate at curved portions 10*c* and each of the rear legs 16 are substantially parallel to each of the front legs 12. Further, each front leg 12 and each rear leg 16 is substantially parallel to each of the other legs of the device 10.

Extension means, generally indicated at 15, may be provided in the front legs 12 to allow the user to adjust the respective lengths of the legs 12 to thereby maximize the user's comfort. The extension means 15 allows the user to partially or completely eliminate the downward incline of the handles 14, shown in FIG. 3. Alternatively, the extension means 15 may be fully retracted to provide the aforementioned incline so that by use of his or her arms, the user is provided with both an upward lift and a slightly forward push such as when the user rises up from a sitting position to a standing position. The structure of the extension means 15 is more fully explained in reference to FIGS. 4–7.

Connecting portion 18 connects the rear legs 16 at the bottom ends thereof and between the curved portions 10*c*. The above-mentioned expansion means, generally indicated at 19, may be provided to allow the user to vary the length of the connecting portion 18 to thereby vary the distance between the parallel handle portions 14. In this manner, the distance between the handle portions 14 may be adjusted to accommodate the physical requirements of the individual user. The structure of the expansion means is discussed in more detail in reference to FIGS. 4–7.

Placement of the portion 18 between the lowermost portions of the rear legs 16 permits more uniform diffusion of the user's weight along the surface of the bed. The above-discussed placement of the connecting portion 18 is generally preferred because of the ease by which the aid 10 may be manufactured. For example, the depicted structure may be constructed by simply bending portions of metallic tubing to obtain the desired dimensions. In this manner, an unitary structure may be obtained which can then be modified to further provide the expansion means 19 and extension means 15 to allow for dimensional adjustments as required by the user of the aid 10 and as more fully described to follow. Alternatively, the aid 10 may be used as manufactured, i.e. as a unitary structure without the expansion means 19 and extension means 15. The aforementioned unitary structure may be manufactured by bending a single piece of tubing in each of six different locations which correspond generally to the curved portions 10*a*, 10*b* and 10*c*. In this manner, the overall structure of the device 10 will be continuous, terminating at the lowermost ends 13 of the front legs 12. End caps 22 are preferably provided to protect the surface of the bed 20, or other flat surface upon which the device 10 is used.

Referring to FIG. 3, illustration is made of the manner in which the aid 10 is used. As shown, the user 11 grasps each of the parallel handle portions 14 to support the user's weight while standing up or sitting down. The user 11 can lower himself or herself to a seated position wherein the user is seated on the flat surface 20. The aid 10 is oriented on the surface 20 so that the user 11, when seated, is positioned generally between the handles 14 and in front of the rear connecting portion 18 as shown. When standing up, the user 11 again grasps the handles 14 to obtain additional leverage by use of the user's arms. The aid 10 thereby provides a means by which the user can shift the user's body weight to the arms, shoulders, and the upper body. In this manner, the user 11 receives additional support and leverage from the device so that the user's legs and back are relieved, in part, from the physical exertion normally experienced when rising without assistance from a seated position. When moving between the standing or sitting positions, the user's weight is supported by the aid 10 and is dispersed, in part, along the length of the connecting portion 18.

Figure 6:
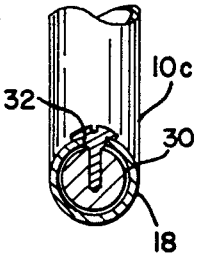
FIG. 6 is a fragmentary cross-sectional view of the convalescent aid substantially as shown in FIG. 4 and taken along the 6—6 line thereof.
Figure 7:
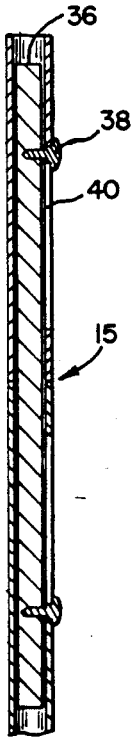
FIG 7 is a fragmentary cross-sectional view of the convalescent aid substantially as shown in FIG. 4 and taken along the 7—7 line thereof.

A second preferred embodiment of convalescent aid 24 incorporating the principles of the present invention is shown in FIGS. 4 thru 7. Except as discussed below, the features of the aid 24 are identical to the features of the aid 10 depicted in FIGS. 1–3 and a description of those features will not be repeated. Like reference numerals have been employed to indicate similar elements. FIGS. 6 and 7 show, in section, some detail of the disclosed expansion means 19 and extension means 15, respectively. The discussion below of FIGS. 6 and 7 is also applicable to the embodiment of FIGS. 1–3.

Figure 4:
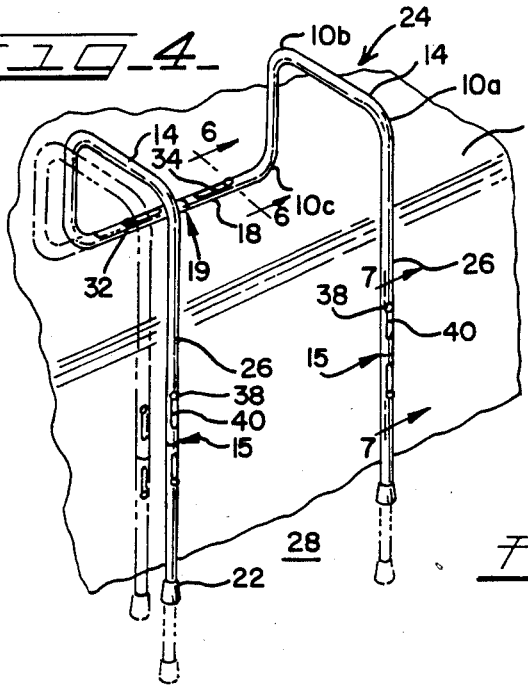
FIG 4 is a perspective view of a second preferred embodiment of convalescent aid incorporating the principles of the present invention.
Figure 5:
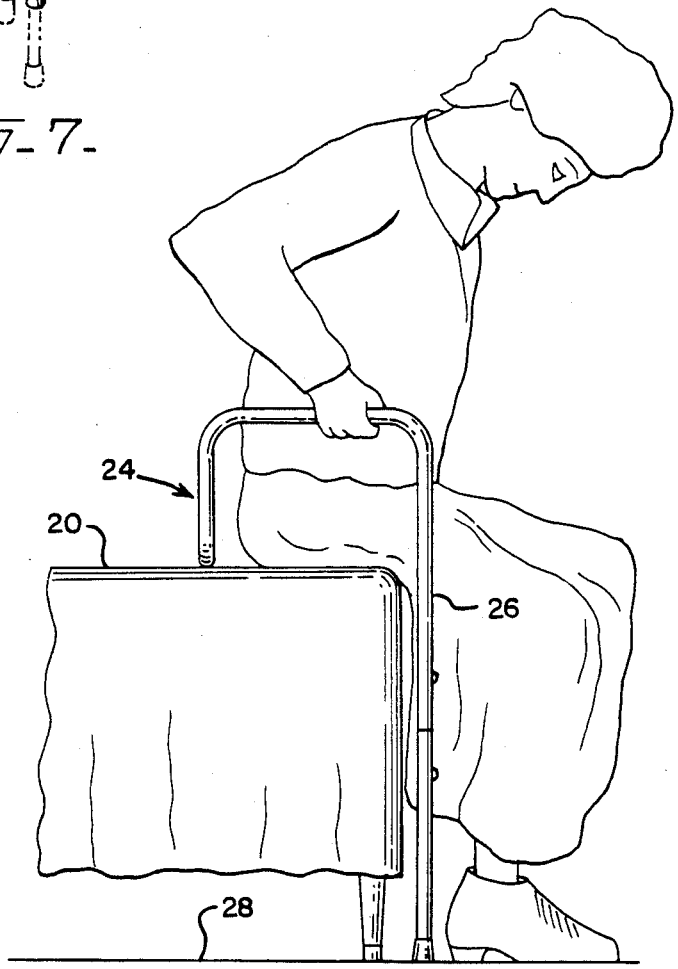
FIG. 5 is a view of the convalescent aid substantially as shown in FIG. 4, and further depicting the use thereof by a person.

As shown in FIG. 4, the aid 24 includes front legs 26 which extend all the way down to the floor 28 from the handles 14 and curved portions 10*a*. In this embodiment, the aid enjoys additional support and stability from the firmer, more stable surface of the floor. End caps 22 are provided to prevent the aid 10 from slipping on the floor 28 and to thereby provide a more secure hold for the user. In all other substantial aspects, the aid of FIGS. 4 and 5 is identical to the aid depicted in FIGS. 1–3.

As shown in FIG. 4, the connecting portion 18 is provided with two sections which are connected by the expansion means 19. Referring to FIG. 6, a cross-sectional view of the expansion means 19 is provided. In the preferred embodiment, the expansion means are provided in the form of an inner tubular member 30 disposed within and connecting the two halves of the connecting portion 18. The inner tubular member 30 is retained within the connecting portion 18 by adjustment screws 32 which are threadedly secured to the inner member 30 and extend through the longitudinal slots 34 provided in each half of the connecting portion 18. In this arrangement of parts, the heads of the screws can be tightened down against the outer surface of the connecting portion 18 to thereby lock the relative positions of the connecting portion 18 and the inner member 30. When the user wishes to increase or decrease the relative distance between the two handle portions 14, the length of the connecting portion can be adjusted, within limits, by sliding one or both halves of connecting portion 18 relative to the inner member 30 to thereby relocate the adjustment screw 32 along the length of the longitudinal slot 34. When the desired handle-to-handle distance is attained, the screw 32 is tightened within the inner member 30 and against the associated half of connecting portion 18 to reversibly lock the parts at the desired adjustment. In this arrangement of parts, a slight adjustment ca be made by adjusting only one half of the connecting portion 18 (shown in phantom in FIG. 4). When desired, a maximum degree of adjustment can be achieved by adjusting the positions of both halves of connecting portion 18 relative to the inner tubular member 30 and in the manner described above.

In a similar manner, the front legs 26 of the aid 10 may also be adjusted by use of the extension means 15 which operate in a manner substantially the same as the expansion means 19. As shown in FIG. 7, an inner member 36 is disposed within each of the front legs 26 with a retaining screw 38 threadedly retained within a screw hole (not shown) in the inner member 36 and passing through the longitudinal slot 40 in the front leg 26. As described above for the expansion means, the relative positions of the inner member 36 and the two halves of the front leg 26 can be adjusted by positioning the retaining screw 38 at the desired position along the length of longitudinal slot 40. These relative positions are maintained by tightening the retaining screw within the slot so that the head of the screw 40 is tightened and frictionally secured against the leg 26. In this manner, both the upper and lower halves of the leg 26 can be adjusted with respect to the inner tubular member 36 to increase or decrease the length of the front legs 26 (shown in phantom in FIG. 4). In this manner, the aid 10 can be used on flat surfaces 20 which are positioned at different heights above the floor 28.

As will be understood by those skilled in the art, alternate structures, not discusses herein, are contemplated for the expansion means 19 and the extension means 15. The described structures are merely meant to be illustrative and should not be construed as a limitation on the manner in which either the extension means 15 or the expansion means 19 may be incorporated into the aid 10.

While the above preferred embodiments of the invention have been shown and described, it will understood that changes and modifications may be made by those skilled in the art without departing from the true spirit and scope of the invention.

What is claimed is:

1. A portable convalescent aid for aiding a partially incapacitated or convalescing individual in moving between a standing position and a sitting position from an elevated flat surface, comprising:

a pair of spaced-apart handle portions, each said handle portion having two ends thereon;

a pair of front leg portions, each said front leg portion extending down from adjacent one end of one of said handle portions, the lower ends of said front leg portions being constructed and arranged to rest upon a surface;

a pair of rear leg portions, each said rear leg portion extending down from adjacent the other end of one of said handle portions said rear leg portions being longer than said front leg portions; and a connecting portion disposed between and connecting said rear leg portions to each other at the lower most ends thereof, said rear leg portions and said front leg portions being dimensioned to rest on said elevated surface to provide said handle portions substantially at the waist level of an individual when seated on said elevated surface so that the individual may readily grasp said handle portions to support the individual's weight thereon and on said connecting portion to assist the individual in moving between the sitting and standing positions.

2. The aid of claim 1 wherein said pair of handle portions define a pair of longitudinally extending axes.

3. The aid of claim 2 wherein said axes are substantially parallel to each other.

4. The aid of claim 1 wherein said handle, leg and connecting portions form an unitary tubular construction.

5. The aid of claim 1 wherein said connection portion further includes expansion means for adjusting the distance between said spaced-apart handle portions.

6. The aid of claim 5 wherein said expansion means include an inner tubular member disposed within and connecting respective halves of said connecting portion, said inner tubular member being secured within said connecting portion by adjustment screws threadedly retained within said inner tubular member and extending through longitudinally extending slots provided in each of said halves of said connecting portion such that the relative positions of said halves of said connecting portion and said inner tubular member are reversibly secured by tightening said adjustment screws against the outer surfaces of said halves of said connecting portion.

7. A convalescent aid for aiding a partially incapacitated or convalescing individual in moving between a standing position and a sitting position from an elevated flat surface, comprising:

a pair of spaced-apart handle portions, each said handle portion having two ends thereon;

a pair of front leg portions, each said front leg portion extending down from adjacent one end of one of said handle portions, the lower ends of said front leg portions being constructed and arranged to rest upon a surface and wherein each said front leg portion further includes extension means for adjusting the length thereof;

a pair of rear leg portions, each said rear leg portion extending down from adjacent the other end of one of said handle portions; and a connecting portion disposed between and connecting said rear leg portions to each other at the lower most ends thereof, said rear leg portions having a length substantially shorter than the individual's arms such that when said connecting portion rests upon said elevated flat surface and the individual is seated on said elevated flat surface between said handle portions, said handle portions are oriented over said elevated surface substantially at waist level so that the individual may readily grasp said handle portions to support the individual's weight thereon and on said connecting portion to assist the individual in moving between the sitting and standing positions.

8. The aid of claim 7 wherein said pair of handle portions define a pair of longitudinally extending axes.

9. The aid of claim 8 wherein said axes are substantially parallel to each other.

10. The aid of claim 7 wherein said front leg portions are substantially parallel to each other.

11. The aid of claim 7 wherein said rear leg portions are substantially parallel to each other.

12. The aid of claim 7 wherein said front leg portions are of a length relative to said rear leg portions, such that both said front leg portions and said connecting portion rest on said elevated surface when said aid is in use.

13. The aid of claim 7 wherein said front leg portions are substantially longer than said rear leg portions, such that said front leg portions extend substantially below said elevated surface when said device is in use.

14. The aid of claim 7 wherein said connection portion further includes expansion means for adjusting the distance between said spaced-apart handle portions.

15. The aid of claim 14 wherein said expansion means include an inner tubular member disposed within and connecting respective halves of said connecting portion, said inner tubular member being secured within said connecting portion by adjustment screws threadedly retained within said inner tubular member and extending through longitudinally extending slots provided in each of said halves of said connecting portion such that the relative positions of said halves of said connecting portion and said inner tubular member are reversibly secured by tightening said adjustment screws against the outer surfaces of said halves of said connecting portion.

16. A convalescent aid for aiding a partially incapacitated or convalescing individual in moving between a standing position and a sitting position from an elevated flat surface, comprising:

a pair of spaced-apart handle portions, each said handle portion having two ends thereon;

a pair of front leg portions, each said front leg portion extending down from adjacent one end of one of said handle portions, the lower ends of said front leg portions being constructed and arranged to rest upon a surface and wherein each of said front leg portion further includes extension means for adjusting the length thereof, said extension means including an inner tubular member disposed within and connecting respective halves of said front leg portion, said inner tubular member being secured within said leg portion by adjustment screws threadedly retained within said inner tubular member and extending through longitudinally extending slots provided in each of said halves of said front leg portion such that the relative positions of said halves of said front leg portion and said inner tubular member are reversibly secured by tightening said adjustment screws against the outer surfaces of said halves of said leg portion;

a pair of rear leg portions, each said rear leg portion extending down from adjacent the other end of one of said handle portions; and a connecting portion disposed between and connecting said rear leg portions to each other at the lower most ends thereof, said rear leg portions having a length substantially shorter than the individual's arms such that when said connecting portion rests upon said elevated flat surface and the individual is seated on said elevated flat surface between said handle portions, said handle portions are oriented over said elevated surface substantially at waist level so that the individual may readily grasp said handle portions to support the individual's weight thereon and on said connecting portion to assist the individual in moving between the sitting and standing positions.

17. The aid of claim 16 wherein said pair of handle portions define a pair of longitudinally extending axes.

18. The aid of claim 16 wherein said axes are substantially parallel to each other.

19. The aid of claim 16 wherein said front leg portions are substantially parallel to each other.

20. The aid of claim 16 wherein said rear leg portions are substantially parallel to each other.

21. The aid of claim 16 wherein said front leg portions are of a length relative to said rear leg portions, such that both said front leg portions and said connecting portion rest on said elevated surface when said aid is in use.

22. The aid of claim 16 wherein said front leg portions are substantially longer than said rear leg portions, such that said front leg portions extend substantially below said elevated surface when said device is in use.

23. The aid of claim 16 wherein said connecting portion further includes expansion means for adjusting the distance between said spaced-apart handle portions.

24. The aid of claim 23 wherein said expansion means include an inner tubular member disposed within and connecting respective halves of said connecting portion, said inner tubular member being secured within said connecting portion by adjustment screws threadedly retained within said inner tubular member and extending through longitudinally extending slots provided in each of said halves of said connecting portion such that the relative positions of said halves of said connecting portion and said inner tubular member are reversibly secured by tightening said adjustment screws against the outer surfaces of said halves of said connecting portion.

* * * * *